US008640262B2

(12) United States Patent
Rossi

(10) Patent No.: US 8,640,262 B2
(45) Date of Patent: Feb. 4, 2014

(54) TOWEL

(71) Applicant: Anita Rossi, Nanuet, NY (US)

(72) Inventor: Anita Rossi, Nanuet, NY (US)

( * ) Notice: Subject to any disclaimer, the term of this patent is extended or adjusted under 35 U.S.C. 154(b) by 0 days.

(21) Appl. No.: 13/675,451

(22) Filed: Nov. 13, 2012

(65) Prior Publication Data

US 2013/0239290 A1 Sep. 19, 2013

Related U.S. Application Data

(60) Provisional application No. 61/611,447, filed on Mar. 15, 2012.

(51) Int. Cl.
*A41D 3/08* (2006.01)

(52) U.S. Cl.
USPC ..... 2/84

(58) Field of Classification Search
USPC ..... 2/46, 69, 69.5, 84, 88, 49.4, 102, 103, 2/104, 106, 115, 247; 297/184.14; 383/4
See application file for complete search history.

(56) References Cited

U.S. PATENT DOCUMENTS

| | | | | |
|---|---|---|---|---|
| 2,513,074 | A | 6/1950 | Wolfe | |
| 4,370,755 | A * | 2/1983 | Crumby | 2/88 |
| 5,110,219 | A | 5/1992 | Lopes et al. | |
| D336,356 | S * | 6/1993 | Shakir | D2/823 |
| 5,629,071 | A | 5/1997 | Feldman | |
| 5,664,258 | A * | 9/1997 | Harris | 2/84 |
| 5,884,331 | A * | 3/1999 | Barajas | 2/69 |
| 5,901,375 | A | 5/1999 | Davis | |
| D410,382 | S | 6/1999 | Therriault | |
| D429,059 | S | 8/2000 | Simmons | |
| 6,156,410 | A | 12/2000 | Bassler | |
| 6,243,873 | B1 | 6/2001 | Aliff | |
| 6,341,379 | B1 * | 1/2002 | Kokus | 2/89 |
| D453,607 | S | 2/2002 | Tracy | |
| 6,708,343 | B1 * | 3/2004 | Ceron | 2/88 |
| 6,851,127 | B1 | 2/2005 | Khan | |
| D560,330 | S | 1/2008 | Williams et al. | |
| D601,327 | S | 10/2009 | Anderson et al. | |
| 7,810,170 | B1 * | 10/2010 | Guthrie | 2/69.5 |

OTHER PUBLICATIONS

Jumping Beans Amanda the Panda Bath Wrap; www.kohls.com.
Jumping Beans Frog Bath Wrap; www.Kohls.com.
Simply Outdoors Blowfish Hooded Beach Towel from Sears.com.
Kids Superhero Towel, Character Towel One Step Ahead Baby; www.onestepahead.com.

* cited by examiner

*Primary Examiner* — Tejash Patel
(74) *Attorney, Agent, or Firm* — Michael E. Zall

(57) ABSTRACT

A towel with a hood fixed to the top edge and two wristbands mounted on the interior of the towel. A person's wrist may be inserted through each band to secure the towel on the person and selectively wrap the towel around their body. At least one pocket is attached to the interior of the towel. A neck strap encircles the neck to secure the towel and hood in place. Each end of the strap is secured to the exterior surface of the towel at the sides of the hood. As a safety feature, at least one end of the neck strap ends is releasably secured to the surface and can be detached therefrom when a predetermined force is exerted on the strap. The towel can be folded into the interior of the hood and the neck strap used as a handle to hold the towel.

6 Claims, 9 Drawing Sheets

TOWEL

RELATED APPLICATION

This application claims priority of Provisional Application No. 61/611,447 filed on Mar. 15, 2012 entitled Fumble Free Stay and Play Beach Towel, the entire disclosure of which is incorporated herein by reference.

FIELD OF THE INVENTION

This invention relates generally to towels, blankets and mats. In particular, this invention relates to a towel that includes a hood. The towel wraps around the shoulders and upper part of the body and is secured to the user. The towel has pockets for placement of accessories, wristbands and a releasable neck strap for assisting in safely securing the towel to the user. The towel is conveniently folded into the hood, the neck strap forming an adjustable carrying handle or shoulder strap.

RELATED ART

The following is a list of US Patents that may be relevant to the patentability of the herein claimed invention:

U.S. Pat. No. D410,382 to Therriault discloses a hooded towel.

U.S. Pat. No. D429,059 to Simmons discloses a combination beach towel, hood, and poncho.

U.S. Pat. No. D453,607 to Tracy discloses a rain blanket with a self-contained carrying bag that is converted into a sleeping bag with a pillow and a hooded raincoat.

U.S. Pat. No. D560,330 to Williams discloses a sports-themed towel.

U.S. Pat. No. D601,327 to Anderson discloses a blanket wrap.

U.S. Pat. No. 2,513,074 to Wolfe describes a combined hood, robe and self-carrier designed to be used in inclement and cold weather to provide a hood over the head and a wrap or blanket to be drawn around the shoulders and upper part of the body.

U.S. Pat. No. 5,110,219 to Lopes describes a beach mat/tote bag made of a rectangular fabric, having anchors thereon that are buried below the beach surface to secure the sheet. An inflatable headrest is removably secured to the sheet.

U.S. Pat. No. 5,629,071 to Feldman describes a beach towel which can be converted into a bag.

U.S. Pat. No. 5,901,375 to Davis describes a multi-purpose garment that is a sheet having a hood attached to it and a first pocket disposed on the inside of the sheet and positioned and sized to receive the hood folded therein. A second pocket is disposed on the outside of the sheet to receive the sheet folded therein.

U.S. Pat. No. 6,156,410 to Bassler describes a hooded towel covering.

U.S. Pat. No. 6,243,873 to Miff describes a rain wrap garment having a panel with a water repellant side and a water absorbing terrycloth side. A hood is attached to the top edge of the panel and is selectively storable in a hood pocket centrally located at the top edge. A storage pocket is located at one of the side edges and is disposed to receive and store the panel when folded to conform to the dimensions of the storage pocket. A shoulder strap is attached to the storage pocket near its opening and is used to carry the rain wrap garment when it is in the folded stored position.

U.S. Pat. No. 6,851,127 to Khan describes a multi-purpose blanket which can be selectively folded for use as a seat cushion or placed into a spread condition for use as a protective covering. The blanket includes a hood, a hood compartment, a pair of pockets, and an elongated storage pouch that is accessible to a user when the blanket is folded into a folded condition for use as a seat cushion.

OBJECTS AND SUMMARY OF THE INVENTION

It is an object of the present invention to provide a towel, or blanket that can be used as a wrap-around protective covering and can be safely secured to the user.

It is yet another object of the present invention to provide a towel with a hood that can be secured in a folded condition and can be easily carried.

Yet another object of the present invention is to provide a hooded towel or blanket that readily converts to a storage compartment when the blanket is in a folded condition.

A further object of the present invention is to provide such a towel that, when placed in a spread condition and positioned over a user, adequately dries and warms the user.

It is a further object of the present invention to provide a towel that is easy to fold and unfold, can be safely secured to the user and is inexpensive and easy to manufacture.

All of the foregoing objects and others are achieved by the towel or blanket of this invention. The towel or blanket has a hood fixed to the top edge and two wristbands mounted on the interior of the towel. A person's wrist may be inserted through each band to secure the towel on the person and selectively wrap the towel around the body. At least one pocket is attached to the interior of the towel. A neck strap encircles the neck to secure the towel and hood in place. Each end of the strap is secured to the exterior surface of the towel at the sides of the hood. As a safety feature, at least one end of the neck strap is releasably secured to the surface and can be detached therefrom when a predetermined force is exerted on the strap. The towel can be folded into the interior of the hood and the neck strap used as a handle to hold the towel.

Other important objects and features of the invention will be apparent from the following Detailed Description of the Invention taken in connection with the accompanying drawings.

DETAILED DESCRIPTION OF THE INVENTION

A preferred embodiment of the present invention is shown in FIGS. 1-12 in which like numerals refer to like features of the invention.

As used herein, the term "towel," generally referenced as 20, is not only used in its usual sense, i.e., an absorbent cloth used for wiping, or drying a person, but for brevity herein also includes its use as a blanket for keeping the user warm, whether while sleeping or otherwise, or use as a mat for lying on, for example, on the beach or a beach chair.

For brevity of description, "Right" and "Left" refer to the side of the towel 20 that the users right hand or left hand, respectively, is near when in use.

The towel 20 of this invention is preferably made of a terry cloth type material that is absorbent to moisture. It may also be made of a blanket type material, wool or other suitable woven material, or other soft, flexible and foldable material. The sheet material used should be sturdy enough to hold up under repeated uses, yet should be preferably made of a material which is easily washable and cared for to insure long life and usage.

Figure 1:
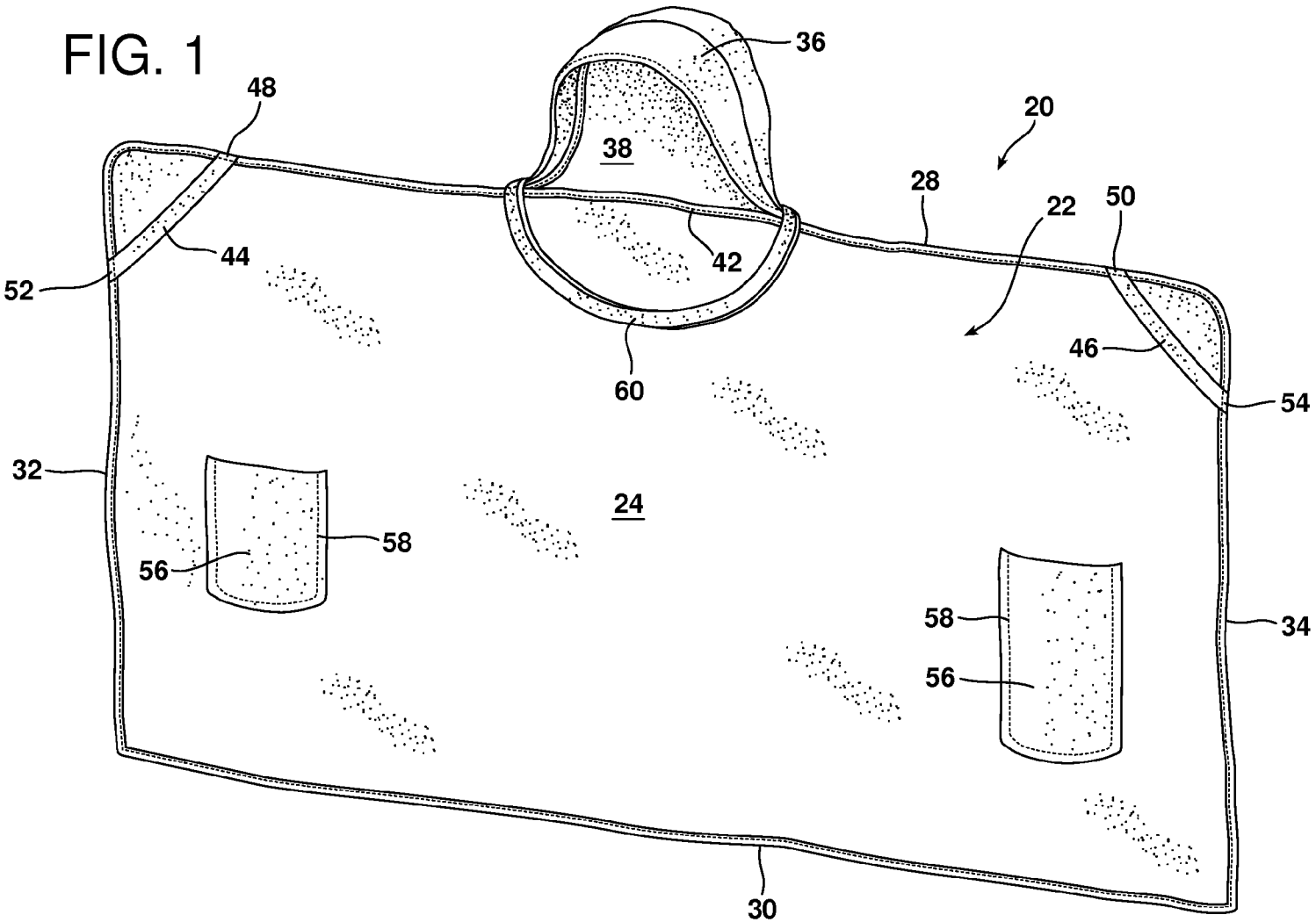
FIG. 1 is a front perspective view of an embodiment of the towel of this invention.
Figure 2:
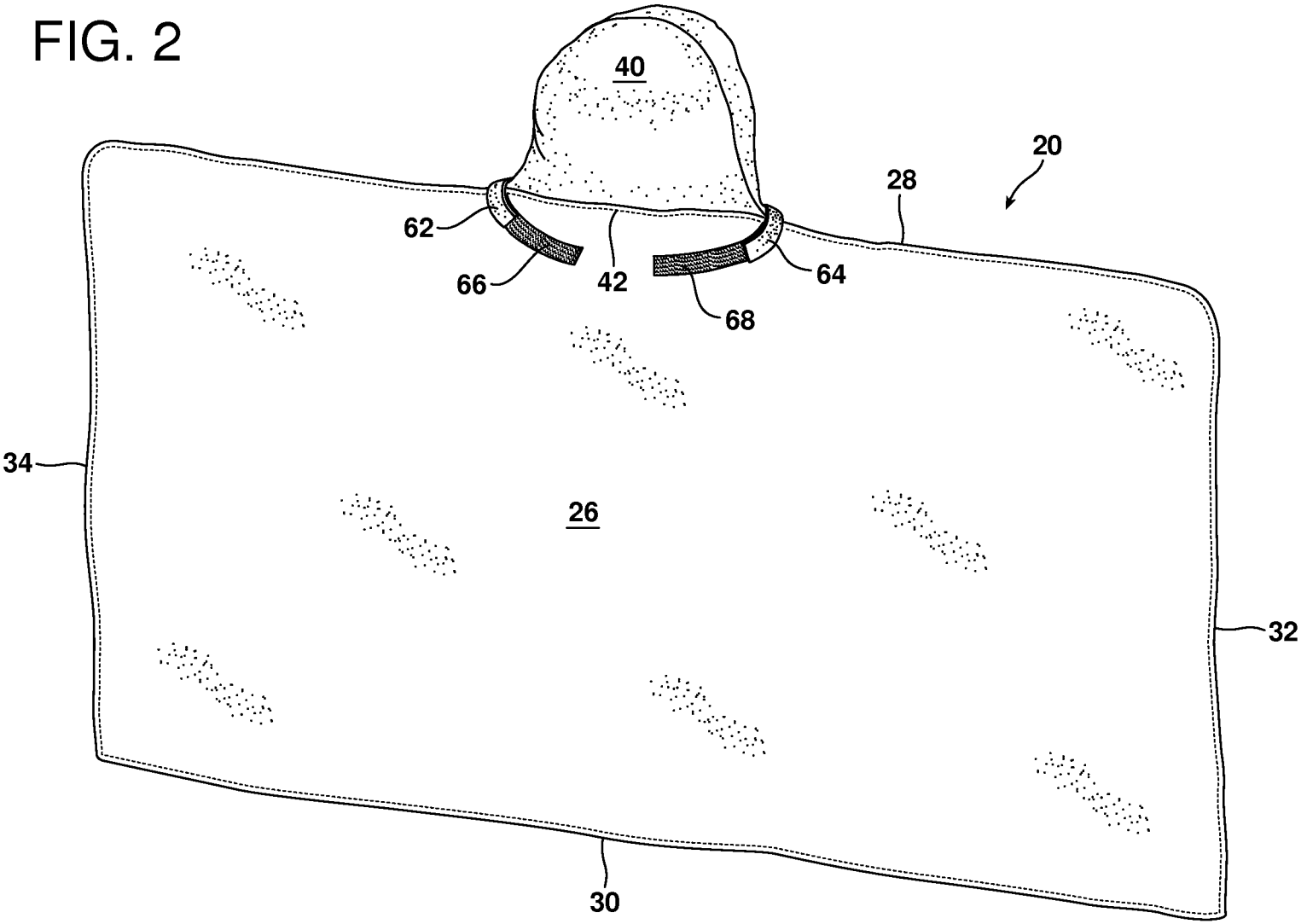
FIG. 2 is a rear perspective view of the embodiment of the towel of this invention shown in FIG. 1.
Figure 3:
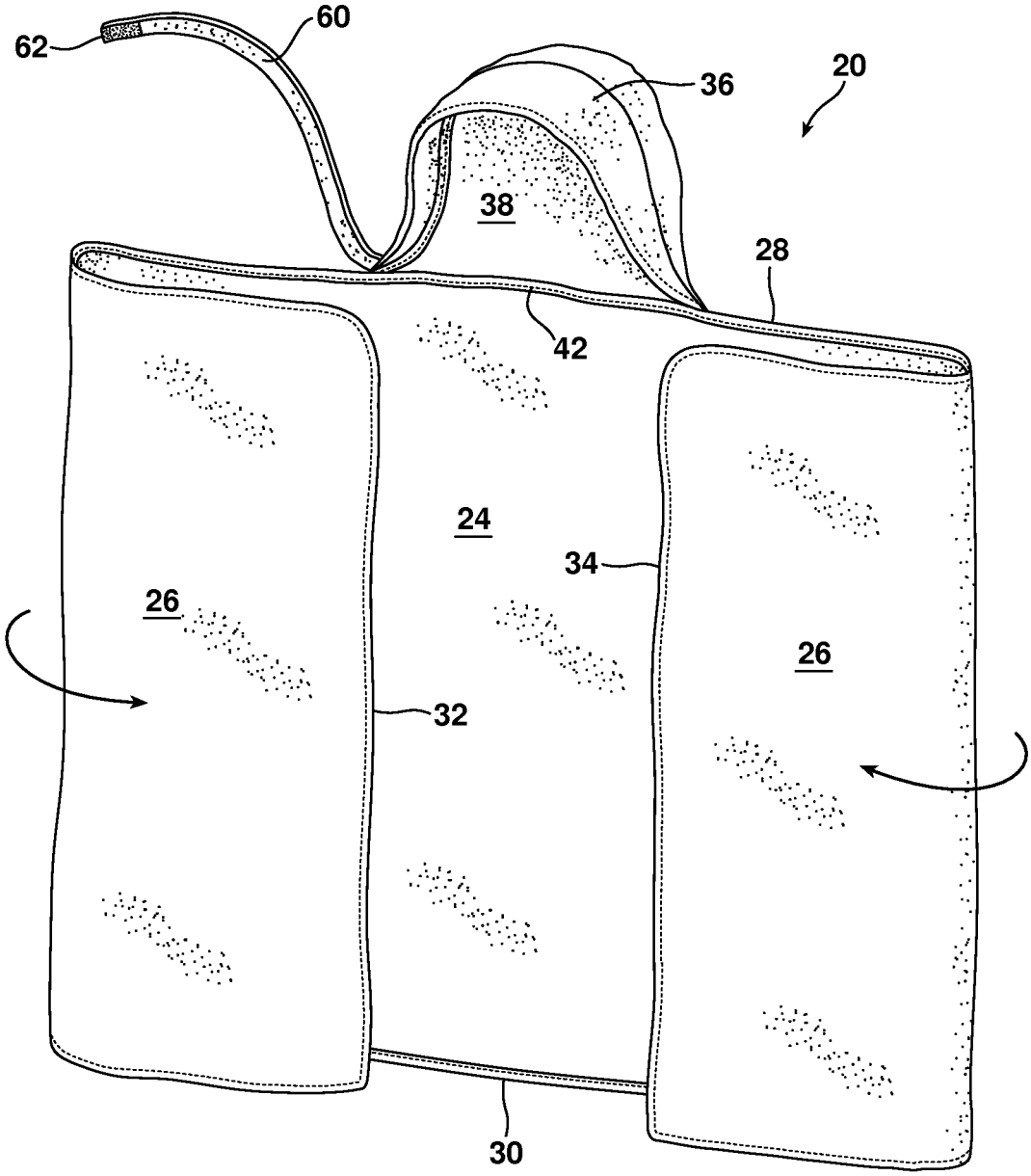
FIGS. 3-9 are perspective views of the towel of this invention illustrating the steps involved in folding the towel from its spread condition for draping over the user to a shoulder bag configuration for carrying.
Figure 4:
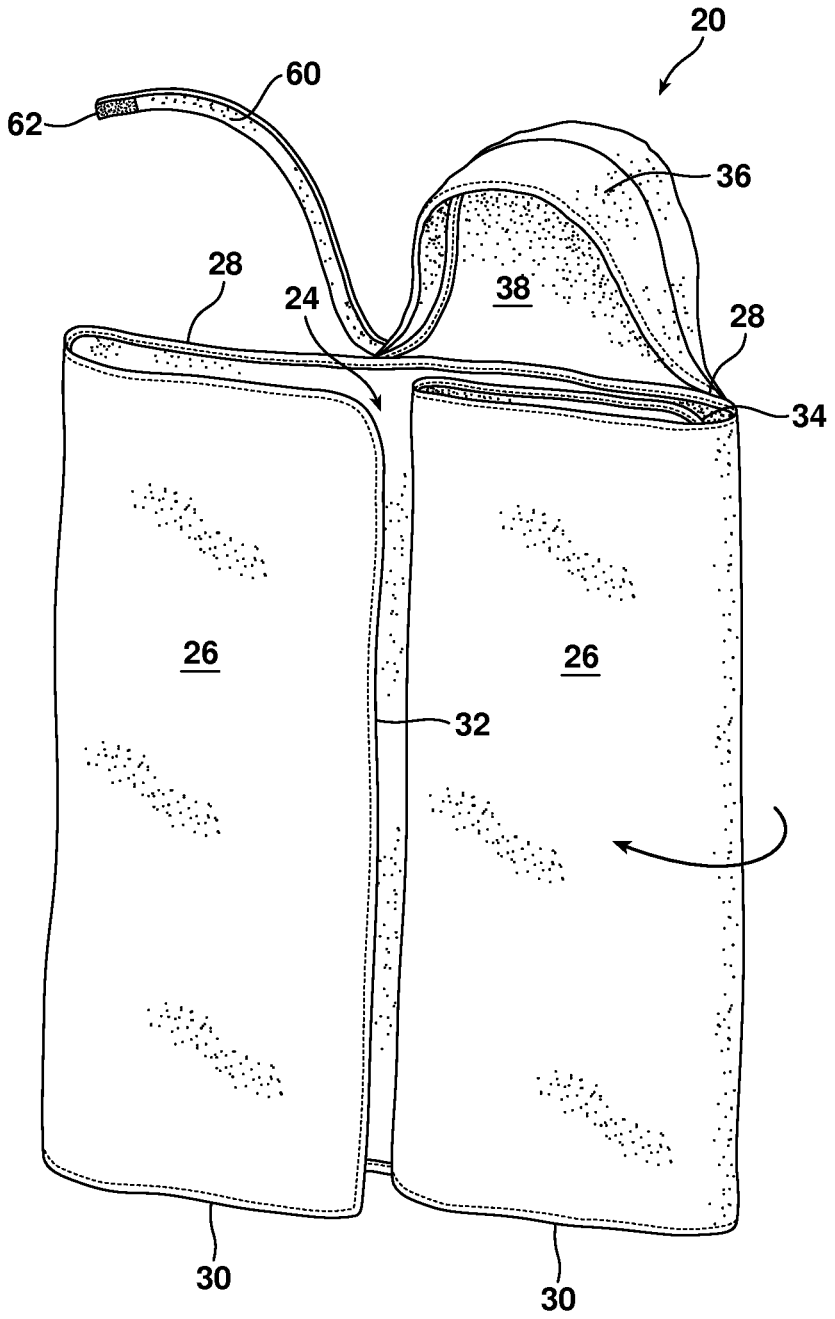
Figure 5:
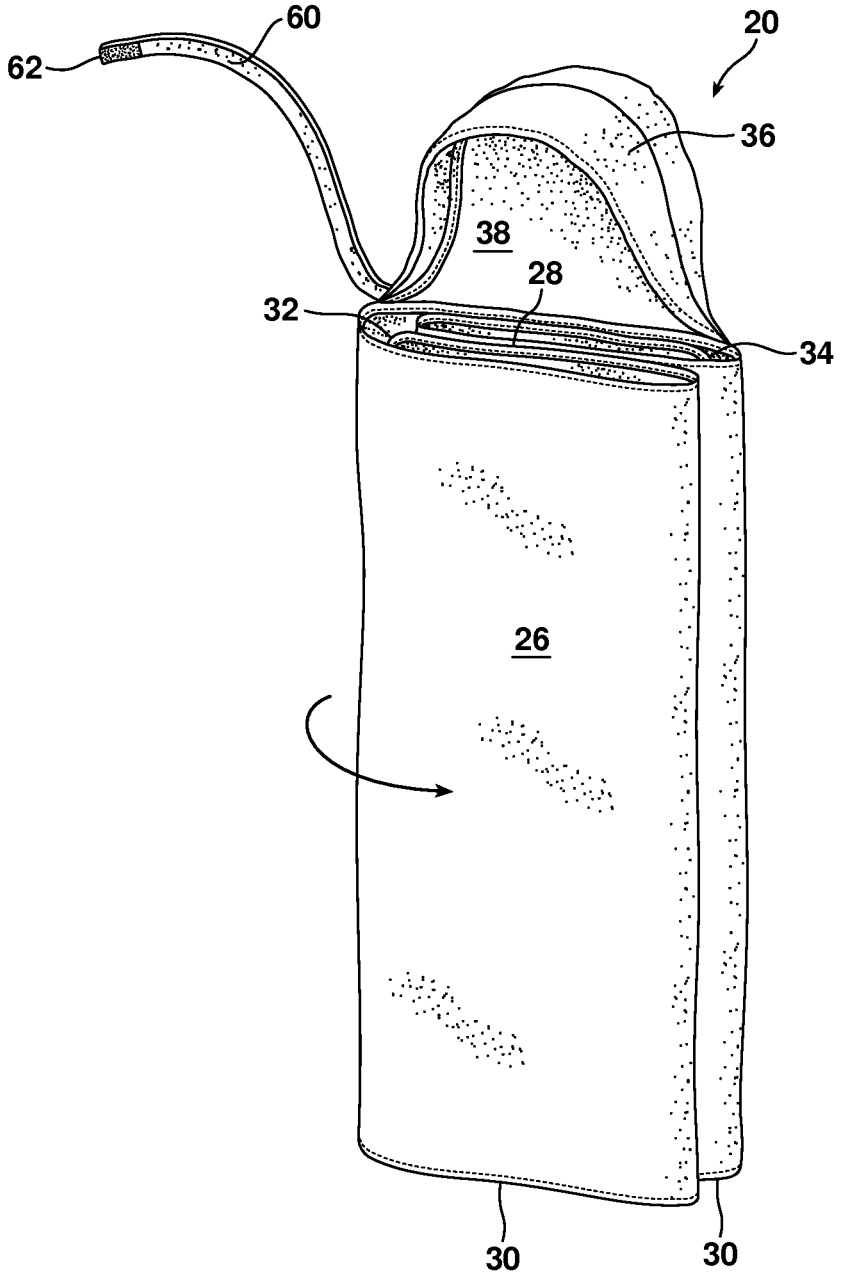
Figure 6:
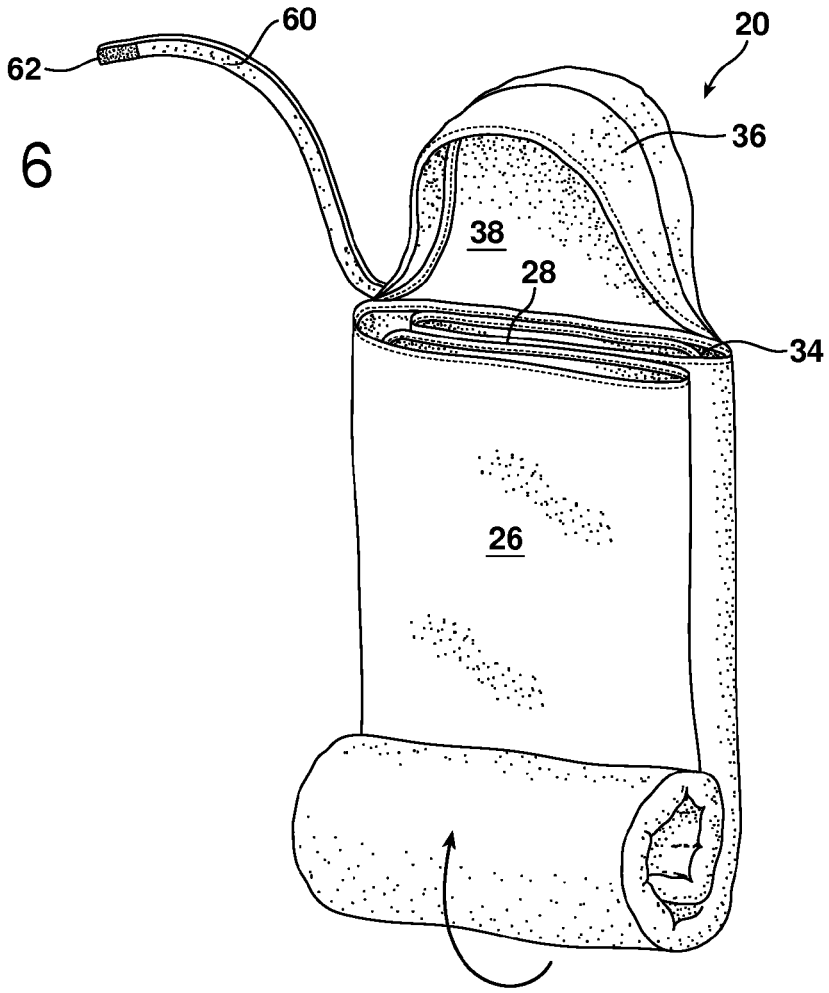
Figure 7:
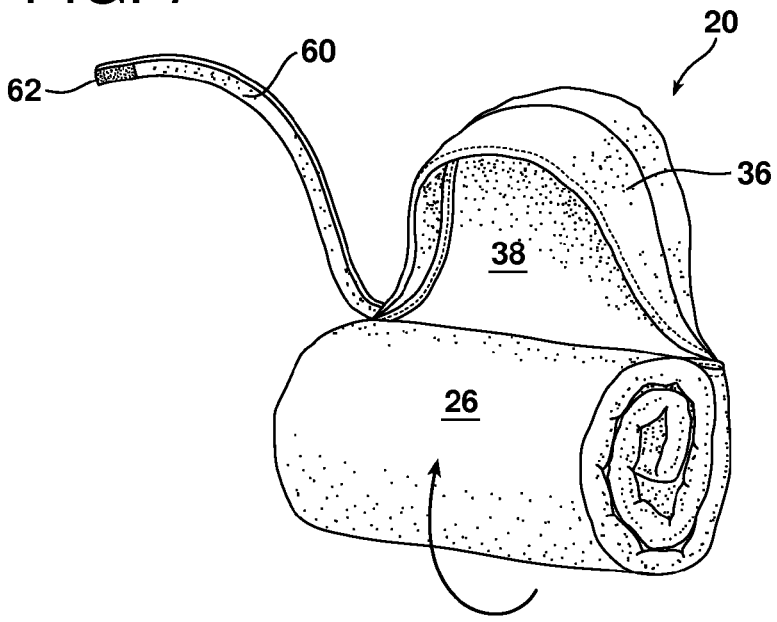
Figure 8:
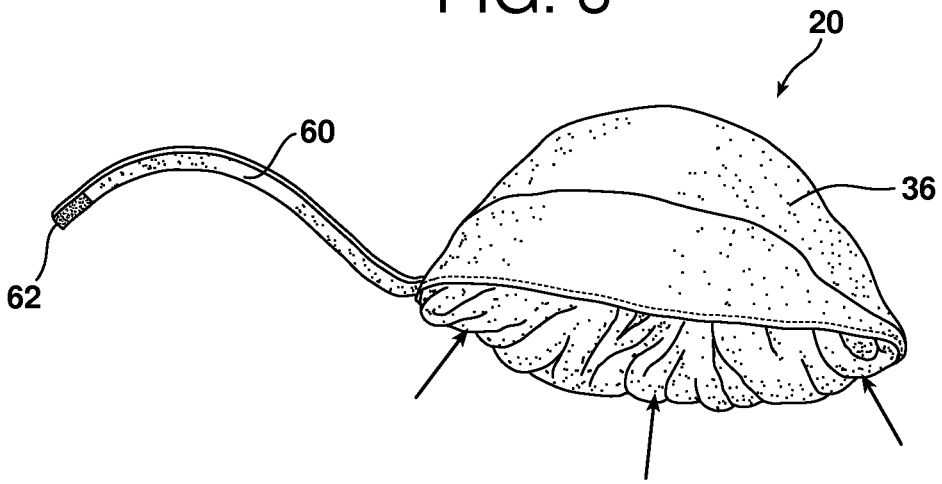
Figure 9:
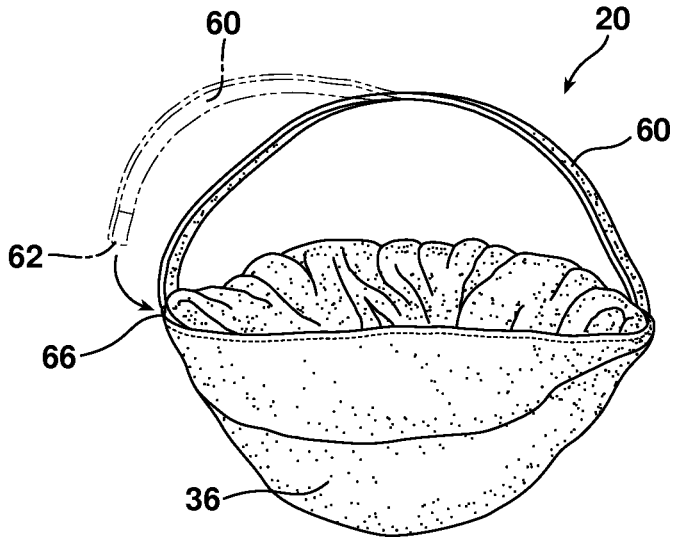

Referring, for example to FIGS. 1 and 2, the towel 20 comprises a flexible foldable fabric panel 22 having an interior surface 24 and an exterior surface 26, a top edge 28, a bottom edge 30, a right edge 32 and a left edge 34. Preferably, the top and bottom edges 28, 30 are substantially parallel to each other as are the right and left edges 32,34, which are perpendicular to the bottom and top edges 28, 30. However, the towel 20 may be of any suitable shape as long as the functionality of the towel 20 described herein is maintained. The fabric panel 22 may have any desirable design thereon.

Referring, for example to FIGS. 1, 2 10 and 11, a hood 36 is provided having an interior surface 38 and an exterior surface 40. The hood 36 is fixed, preferably but not necessarily, by stitching 42 proximate to the top edge 28 of the fabric panel 22. Generally, the hood 36 is centered on the top edge 28 between side edges 32, 34. Preferably, the interior surface 38 of the hood 36 is substantially coplanar with the interior surface 22 of the fabric panel 24.

Figure 10:
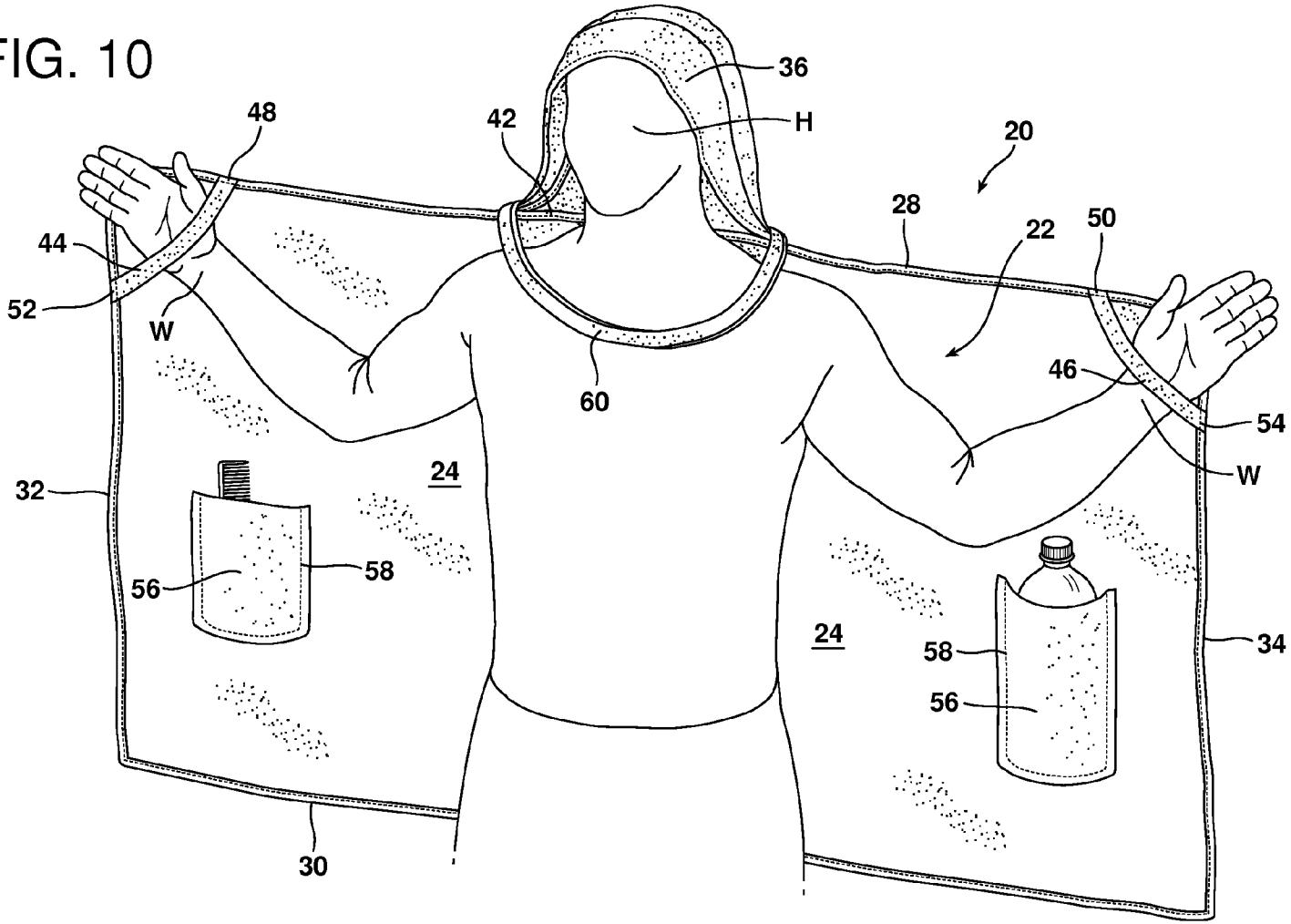
FIG. 10 is a perspective view of the towel of this invention in use.

Referring to FIG. 10, the hood 36 is shaped to conform to and enclose the top and rear portion of a person's head H. Preferably the exterior surface 40 of the hood 36 is also substantially coplanar with the exterior surface 26 of the fabric panel 22.

Referring to FIGS. 1 and 10, the towel 22 further includes a right wristband 44 and a left wristband 46 overlying the interior surface 22 of the fabric panel 22. Each wristband 44, 46 has one end 48, 50 attached proximate to the top edge 28 of the fabric panel 22. In the preferred embodiment these ends 48, 50 are attached to the top edge 28 by stitching. However, this invention contemplates that the ends 48, 50 may be attached below, but near the top edge 28 by stitching, clips or hook and loop fasteners, e.g., VELCRO® brand. The other ends 52, 54 of wristbands 44, 46, respectively, are attached proximate to the right edge 32 and left edge 34, respectively, of the fabric panel 22. Likewise, in the preferred embodiment these ends 52, 54 are attached to the right edge 32 and left edge 34, respectively, by stitching. However, this invention also contemplates that the ends 52, 54 may also be attached near the side edges 32, 34 by stitching, clips or hooks and loop fasteners, e.g., VELCRO® brand fasteners. As shown in FIG. 10, in use the person using the towel slips his wrists W between the wristband 44, 46 and the interior surface 24 of the fabric panel 22. This arrangement leaves the person's hands free to manipulate the towel 20 around his/her shoulders, place items in the pockets 56, etc.

Referring again to FIGS. 1 and 10, at least one pocket 56 is mounted to the interior surface 24 of the fabric panel 22. It is to be understood that any number of pockets may be used, not only on the interior surface 24 but also on the exterior surface 26 of the fabric panel. It is preferred, as depicted herein, that two (2) conveniently located pockets 56 are provided which are accessible to the hands of a user when the towel 20 is wrapped about his/her torso. In the embodiment depicted, for ease of access theses pockets 56 are located proximate to the right edge 32 or left edge 34 of the fabric panel 22. Each pocket 56 is comprised, in part, of a piece of flexible material which is sewn along its side and bottom edges 58 to the material of the interior surface 24 and the resultant opening of the pocket 56 opens in a convenient position for placement of items in the pockets 56, see FIG. 10. Each pocket 56 (or its opening thereof) may be canted with respect to the corresponding side edge 34, 32 of the towel 20 so that the pocket opening opens inwardly of the side edges of the blanket 34, 32 to enhance the accessibility of the pockets 56 to the hands of the user, when the towel 20 is worn (e.g. across the user's shoulders). In addition, each pocket opening is spaced a distance from the top edge 28 so that when the towel 20 is draped about the shoulders of a user, the pockets 56 are disposed at a convenient height for accepting the hands of the user.

Referring to the Figures, and in particular FIGS. 1-3, 8 and 9, a neck strap 60 is provided. One end 62 of the neck strap 60 is secured at a first location 66 proximate to the top edge 28 of the fabric panel 22 on one side (the left side) of the hood 36 on the exterior surface 26 of the fabric panel 22. The other end 64 of the neck strap 60 is secured at a second location 68 proximate the top edge 28 of the fabric panel 22 on the other side (the right side) of the hood 36 on the exterior surface 26 of the fabric panel 22. The neck strap 60 encircles the user's neck to hold the towel 20 and hood 36 in place on the person.

At least one end 62 or 64 and preferably both ends 62 and 64 of the neck strap are releasably secured to the locations 66, 68 exterior surface 26 of the fabric panel 22 when a predetermined force is applied to the neck strap 60. Preferably the predetermined force to detach at least one end of the neck strap 60 from the exterior of the fabric panel 26 is a force sufficiently low so as not to injure the neck of the person and sufficiently high to comfortably secure the towel to the person 20. Preferably, the neck strap 60 uses a hook and loop, e.g., VELCRO® brand, fastener systems to attach the ends 62, 64 to the locations 66, 68 on the exterior surface 26 of the fabric panel. Methods of determining the predetermined force needed for safety purposes are well known, particularly with hook and loop fasteners. For example, increasing the area of the bond, increasing the number of hooks and loops per area unit, etc. will increase the force needed to remove the secured end and vice versa. Optionally, the neck strap may have "break away points". However, such breakaway points once broken cannot be repaired and used again unless they are hook and loop type connections.

Figure 11:
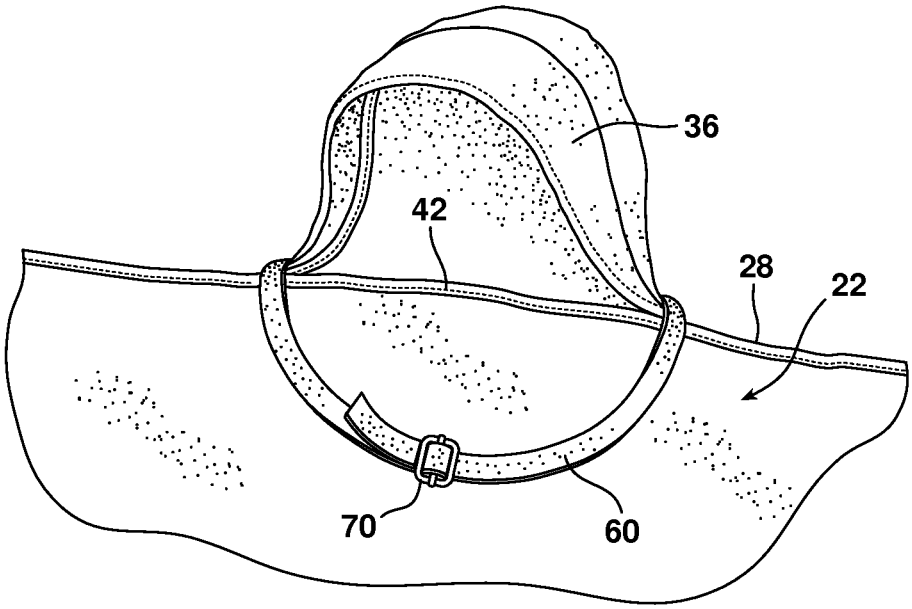
FIG. 11 is a front perspective view of the towel of this invention with an adjustable strap.
Figure 12:
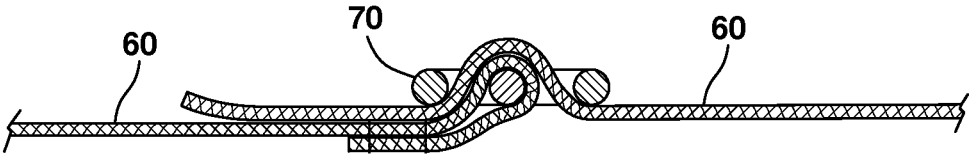
FIG. 12 is cross-sectional view of the adjustment, buckle used on the adjustable strap.

Referring to FIGS. 11 and 12, optionally the neck strap 60 includes an adjustment means, e.g., adjustment clip 70 connecting two portions of the strap 60, for adjusting the length of the neck strap 60 located on the neck strap between the ends.

Referring to FIG. 10, in use, the person wearing the towel 20 can selectively wrap the towel around their body to cover the body or open the towel to expose the body, and selectively retrieve or place an item in the pockets 56. Referring sequentially to FIGS. 3-9, the fabric panel 22 can be folded into the interior of the hood 36 and the ends of the neck strap 62, 64 attached to the respective first and second locations 66, 68 and used as a handle or shoulder strap to hold the towel 20. This provides a very compact arrangement for carrying and adds additional carrying capability for small items. In addition, when the fabric panel 22 is arranged within the bag or pocket formed by the hood 36, it may also serve as a seat cushion or pillow.

The exact fabric from which the invention may be comprised is not critical to the functioning of the invention, as it is believed that any fibrous material capable of being woven into a sheet or cloth is suitable. This includes without limitation, cotton, linen, rayon, wool, nylons, polyesters, canvas, silk, or blends thereof. However, the garment may be lined on the interior surface 24 which contacts the wearer when used as a body wrap with a soft fiber lining, such as cotton, and may have as its exterior surface 26 when worn as a body wrap a wind-breaking and weather proof layer.

Various fastening means may be employed at any location on the garment desired for convenience in securing either portions of the garment to itself, including but not limited to areas of hook-and-loop type fastening means.

While various changes can be made in the detailed construction and processes of this invention, it will be understood that such changes will be within the spirit and scope of the present invention. Having thus described the invention in detail, it is to be understood that the foregoing description is not intended to, limit the spirit and scope thereof. What is desired to be protected by Letters Patent is set forth in the appended claims.

The invention claimed is:

1. A towel comprising:

a fabric panel having an interior surface and an exterior surface, a top edge, a bottom edge, a right edge and a left edge;

a hood having an interior surface and an exterior surface, the hood fixed proximate to the top edge of the fabric panel, the interior surface of the hood shaped to enclose a top and rear portion of a person's head;

a first wrist band overlying the interior surface of the fabric panel, one end of which is attached proximate to the top edge of the fabric panel and another end of which is attached proximate to the left edge of the fabric panel, wherein one wrist of a person can pass between the first wrist band and the interior surface of the fabric panel;

a second wrist band overlying the interior surface of the fabric panel, one end of which is attached proximate to the top edge of the fabric panel and another end of which is attached proximate to the right edge of the fabric panel, wherein a second wrist of the person can pass between the second wrist band and the interior surface of the fabric panel;

at least one pocket mounted to the interior surface of the fabric panel proximate to the right edge or left edge of the fabric panel;

a neck strap secured at one end at a first location proximate to the top edge of the fabric panel on one side of the hood on the exterior surface of the fabric panel, an another end secured at a second location to the top edge of the fabric panel on another side of the hood on the exterior surface of the fabric panel, the neck strap encircling a person's neck to hold the towel and hood in place on the person, wherein at least one end of the neck strap is releasably secured to the exterior surface of the fabric panel;

whereby the person wearing the towel can selectively wrap the towel around their body to cover the body or open the towel to expose the body, and selectively retrieve or place an item in the at least one pocket;

whereby the one end of the neck strap that is releasably secured to the exterior surface of the fabric panel can be detached from the exterior of the fabric panel when a predetermined force is exerted on the neck strap;

whereby the fabric panel can be folded into the interior of the hood and the one end of the neck strap and the other end of the neck strap are attached to the respective first and second locations is a handle to hold the towel.

2. The towel of claim 1, wherein the at least one pocket is mounted to the interior surface of the fabric panel proximate to the right edge of the fabric panel.

3. The towel of claim 2, further comprising another pocket mounted to the interior surface of the fabric panel proximate to the left side of the fabric panel.

4. The towel of claim 1, wherein the respective ends of the neck strap are secured at the respective first and second locations on the exterior surface of the fabric panel by hook or loop surfaces on the ends and mating hook or eye surfaces at the respective first and second locations on the exterior surface of the fabric panel.

5. The towel of claim 1, wherein the predetermined force to detach at least one end of the neck strap from the exterior of the fabric panel is a force sufficiently low so as not to injure a neck of the person.

6. A towel comprising:

a fabric panel having an interior surface and an exterior surface, a top edge, a bottom edge, a right edge and a left edge;

a hood having an interior surface and an exterior surface, the hood fixed proximate to the top edge of the fabric panel, the interior surface of the hood shaped to enclose a top and rear portion of a person's head;

a first wrist band overlying the interior surface of the fabric panel, one end of which is attached proximate to the top edge of the fabric panel and another end of which is attached proximate to the left edge of the fabric panel, wherein one wrist of a person can pass between the first wrist band and the interior surface of the fabric panel;

a second wrist band overlying the interior surface of the fabric panel, one end of which is attached proximate to the top edge of the fabric panel and another end of which is attached proximate to the right edge of the fabric panel, wherein a second wrist of the person can pass between the second wrist band and the interior surface of the fabric panel;

a neck strap secured at one end at a first location proximate to the top edge of the fabric panel on one side of the hood on the exterior surface of the fabric panel, the other end secured at a second location to the top edge of the fabric panel on another side of the hood on the exterior surface of the fabric panel, the neck strap encircling a person's neck to hold the towel and hood in place on the person, wherein at least one end of the neck strap is releasably secured to the exterior surface of the fabric panel;

whereby the person wearing the towel can selectively wrap the towel around their body to cover the body or open the towel to expose the body;

whereby at least one end of the neck strap can be detached from the exterior of the fabric panel when a predetermined force is exerted on the neck strap and the predetermined force to detach the one end of the neck strap that is releasably secured to the exterior surface of the fabric panel from the exterior of the fabric panel is a force sufficiently low so as not to injure a neck of the person;

whereby the fabric panel can be folded into the interior of the hood and the one end of the neck strap and the other end of the neck strap attached to the respective first and second locations is a handle to hold the towel.

* * * * *